US009874311B2

(12) United States Patent
Morales et al.

(10) Patent No.: US 9,874,311 B2
(45) Date of Patent: Jan. 23, 2018

(54) COMPOSITE PRESSURE VESSEL HAVING A THIRD GENERATION ADVANCED HIGH STRENGTH STEEL (AHSS) FILAMENT REINFORCEMENT

(71) Applicant: GM Global Technology Operations LLC, Detroit, MI (US)

(72) Inventors: Arianna T. Morales, Royal Oak, MI (US); Mahmoud H. Abd Elhamid, Troy, MI (US); Mei Cai, Bloomfield Hills, MI (US); Anne M. Dailly, West Bloomfield, MI (US)

(73) Assignee: GM GLOBAL TECHNOLOGY OPERATIONS LLC, Detroit, MI (US)

( * ) Notice: Subject to any disclaimer, the term of this patent is extended or adjusted under 35 U.S.C. 154(b) by 736 days.

(21) Appl. No.: 14/303,815

(22) Filed: Jun. 13, 2014

(65) Prior Publication Data

US 2015/0362125 A1 Dec. 17, 2015

(51) Int. Cl.
*F17C 1/06* (2006.01)
*F17C 1/14* (2006.01)
(Continued)

(52) U.S. Cl.
CPC ..... *F17C 1/06* (2013.01); *F17C 1/00* (2013.01); *F17C 1/14* (2013.01); *F17C 13/002* (2013.01);
(Continued)

(58) Field of Classification Search
CPC ..... F17C 1/00; F17C 1/06; F17C 1/14; F17C 13/002; F17C 2201/054; F17C 2201/056; F17C 2201/058; F17C 2201/0109; F17C 2201/0123; F17C 2203/0665; F17C 2203/067; F17C 2260/011; F17C 2260/017; F17C 2221/033; F17C 2223/036; F17C 2223/0604; F17C 2223/0609;
(Continued)

(56) References Cited

U.S. PATENT DOCUMENTS 2,335,038 A * 11/1943 Bridges ..... B21F 17/00 140/2
6,357,439 B1 * 3/2002 Cook ..... A62B 9/00 128/200.24
(Continued)

FOREIGN PATENT DOCUMENTS

WO WO 2013/083177 6/2013
WO WO 2013/083180 6/2013

OTHER PUBLICATIONS

Vuorinen, Esa, "Structure and Properties of Advanced Fine Grained Steels Produced Using Novel Thermal Treatments", Doctoral Thesis, Lulea University of Technology, 2012, 134 pages.
(Continued)

*Primary Examiner* — Chun Cheung
*Assistant Examiner* — Brijesh V. Patel
(74) *Attorney, Agent, or Firm* — Harness, Dickey & Pierce, P.L.C.

(57) ABSTRACT

A composite pressure vessel includes a liner to contain a pressurized fluid and a composite layer formed on at least a portion of an exterior surface of liner. The composite layer includes a third generation advanced high strength steel filament reinforcement embedded in a polymer matrix.

21 Claims, 6 Drawing Sheets

(51) Int. Cl.
*F17C 13/00* (2006.01)
*F17C 1/00* (2006.01)

(52) U.S. Cl.
CPC ..... *F17C 2201/0109* (2013.01); *F17C 2201/0123* (2013.01); *F17C 2201/054* (2013.01); *F17C 2201/056* (2013.01); *F17C 2201/058* (2013.01); *F17C 2203/0604* (2013.01); *F17C 2203/067* (2013.01); *F17C 2203/0609* (2013.01); *F17C 2203/0639* (2013.01); *F17C 2203/0656* (2013.01); *F17C 2203/0663* (2013.01); *F17C 2203/0665* (2013.01); *F17C 2221/033* (2013.01); *F17C 2223/0123* (2013.01); *F17C 2223/036* (2013.01); *F17C 2260/011* (2013.01); *F17C 2260/017* (2013.01)

(58) Field of Classification Search
CPC ..... F17C 2223/0639; F17C 2223/0663; F17C 2223/0656; B65D 13/00; B65D 90/029; B29C 5/602; B29C 5/665; B32B 31/02; B32B 15/08; B32B 15/14; B32B 27/04; B32B 27/12
USPC ..... 220/4.12, 62.11, 62.19, 560.05–560.06, 220/560.08, 560.12, 581, 586, 588–590, 220/592, 592.25, 646, 648, 901; 156/173, 156/178–179, 324, 437; 428/34.6, 35.5, 428/36.3–36.4; 442/6, 7, 19
See application file for complete search history.

(56) References Cited

U.S. PATENT DOCUMENTS

| | | | | |
|---|---|---|---|---|
| 8,602,250 | B2 | 12/2013 | Berger et al. | |
| 9,249,931 | B2 | 2/2016 | Morales et al. | |
| 9,328,868 | B2 | 5/2016 | Dailly et al. | |
| 2004/0242096 | A1* | 12/2004 | Prakash | B32B 27/04 442/19 |
| 2009/0095796 | A1* | 4/2009 | Prakash | F17C 1/06 228/184 |
| 2011/0204064 | A1* | 8/2011 | Crane | F17C 1/00 220/592 |
| 2011/0220660 | A1 | 9/2011 | Strack | |
| 2013/0082066 | A1 | 4/2013 | Prakash et al. | |
| 2013/0233452 | A1 | 9/2013 | Branagan et al. | |
| 2014/0014667 | A1 | 1/2014 | Flammer | |
| 2014/0166670 | A1* | 6/2014 | Sirosh | F17C 1/02 220/581 |
| 2014/0290283 | A1 | 10/2014 | Ortmann et al. | |
| 2014/0290611 | A1 | 10/2014 | Abd Elhamid et al. | |
| 2014/0290751 | A1 | 10/2014 | Dailly et al. | |
| 2014/0291048 | A1 | 10/2014 | Morales et al. | |

OTHER PUBLICATIONS

Fekete, Jim, et al., "Workshop on Addressing Key Technology Gaps in Implementing AHSS for Automotive Lightweighting", NIST Internal Report 6668, 2012, 33 pages.
Tamarelli, Carrie M., et al., "AHSS 101: The Evolving Use of Advanced High-Strength Steels for Automotive Applications", Steel Market Development Institute, 45 pages.
Branagan, Daniel, "Overview of a New Category of 3rd Generation AHSS", Great Designs in Steel 2013 Seminar, The NanoSteel Company Inc., 29 pages.
"Nano-engineered steels for structural applications", nanowerk, 2010, 14 pages, http://www.nanowerk.com/spotlight/spotid=16203.php.
Laboratory Test Procedure for FMVSS 304 Compressed Natural Gas (CNG) Fuel Container Integrity, U.S. Department of Transportation National Highway Traffic Safety Administration, 2003, 50 pages.

* cited by examiner

COMPOSITE PRESSURE VESSEL HAVING A THIRD GENERATION ADVANCED HIGH STRENGTH STEEL (AHSS) FILAMENT REINFORCEMENT

TECHNICAL FIELD

The present disclosure relates generally to a composite pressure vessel.

BACKGROUND

Pressure vessels, such as, e.g., gas storage containers and hydraulic accumulators may be used to contain fluids under pressure. It may be desirable to have a pressure vessel with relatively thin walls and low weight. For example, in a vehicle fuel tank, relatively thin walls allow for more efficient use of available space, and relatively low weight allows for movement of the vehicle with greater energy efficiency. Further, a thinner wall tank allows for faster heat exchange during refueling, thereby allowing better thermal management.

SUMMARY

A composite pressure vessel includes a liner to contain a pressurized fluid and a composite layer formed on at least a portion of an exterior surface of liner. The composite layer includes a third generation advanced high strength steel filament reinforcement embedded in a polymer matrix.

BRIEF DESCRIPTION OF THE DRAWINGS

Features and advantages of examples of the present disclosure will become apparent by reference to the following detailed description and drawings, in which like reference numerals correspond to similar, though perhaps not identical, components. For the sake of brevity, reference numerals or features having a previously described function may or may not be described in connection with other drawings in which they appear.

DETAILED DESCRIPTION

Definitions

Figure 1A:
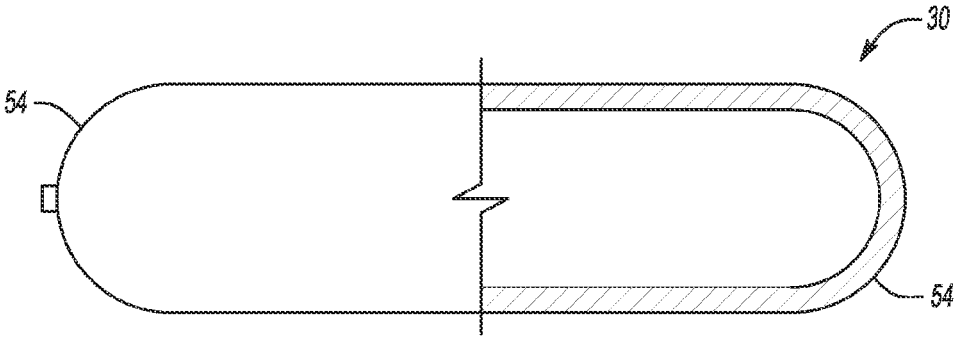
Fig-1A PRIOR ART
FIG. 1A is a cutaway, cross-sectional view of a Type I pressure vessel.

As used herein, the word "filament" means a single fiber, wire, flat wire, or low, flat profile band. A single continuous filament that may be rolled on a spool is a "monofilament" as used herein. Filaments in a bunch are called a "strand" or an "end." If the filaments are all parallel to each other, the "end" is called a "roving," although graphite rovings are also referred to as "tows." If the filaments are twisted to hold the fibers or wires together, the bundle is called a "yarn."

Either roving (tow) or yarn can be woven into a fabric. If roving is used, the fabric is called "woven roving;" if yarn is used, the fabric is called "cloth." Although the terms "yarn" and "roving" are not interchangeable, where the word "yarn" is applied in this document, it is to be understood that "roving" may be applied also. Nonwoven fabric is a fabric-like material such as "felt" made from long fibers, bonded together by chemical treatment, mechanical treatment, heat treatment, or solvent treatment.

In a roll of fabric, "warp yarns" run in the direction of the roll and are continuous for the entire length of the roll. "Fill yarns" run crosswise to the roll direction. Warp yarns are usually called "ends" and fill yarns "picks." (The terms apply equally to rovings, but yarn will be used in the rest of the discussion for simplicity.)

Fabric count refers to the number of warp yarns (ends) and fill yarns (picks) per inch. For example, a 24×22 fabric has 24 ends in every inch of fill direction and 22 picks in every inch of warp direction. Note that warp yarns are counted in the fill direction, and fill yarns are counted in the warp direction.

If the end and pick counts are roughly equal, the fabric is considered "bidirectional" (BID). If the pick count is very small, most of the yarns run in the warp direction, and the fabric is nearly unidirectional. Some unidirectional cloths have no fill yarns; instead, the warp yarns are held together by a thin stream of glue. "Unidirectional prepreg" relies on resin to hold the fibers or wires together.

"Weave" describes how the warp and fill yarns are interlaced. Examples of weaves are "plain," "twill," "harness satin," and "crow-foot satin." Weave determines drapeability and isotropy of strength.

"Composite material" means engineered material made from two or more constituent materials with significantly different physical or chemical properties which remain separate and distinct on a macroscopic level within the finished structure. There are two categories of constituent materials: matrix and reinforcement. The matrix material surrounds and supports the reinforcement material by maintaining their relative positions. The reinforcements impart their special mechanical and physical properties to enhance the matrix properties. A synergism produces material properties unavailable from the individual constituent materials.

Reinforcement materials include fiberglass, carbon fiber, aramid fiber and the like. As disclosed herein, reinforcement material may also include metal filaments, e.g. steel and third generation nanostructured steel filaments.

A polymer matrix material is often called a resin solution. The most commonly known polymer matrix materials are polyesters, vinyl esters, epoxies, phenolic polymers, polyimides, polyamides, polypropylenes, polyether ether ketone (PEEK), and the like. It is to be understood that these polymer examples are not intended to be limiting, and that other materials are contemplated as being within the purview of the present disclosure.

"Full-wrapped" means applying the reinforcement of a filament or resin system over the entire liner, including the domes.

"Hoop-wrapped" means winding of filament in a substantially circumferential pattern over the cylindrical portion of the liner so that the filament does not transmit any significant stresses in a direction parallel to the cylinder longitudinal axis.

"Liner" means an inner, gas tight container or gas cylinder to which the overwrap is applied.

"Service pressure (S.P.)" means an internal settled pressure of a CNG fuel container at a uniform gas temperature of 70° F. (21° C.) and full gas content. It is the pressure for which the container has been constructed under normal conditions.

"Burst pressure" means a highest internal pressure reached in a CNG fuel container during an FMVSS 304 burst test at a temperature of 70° F. (21° C.).

"Burst ratio" means a ratio of burst pressure to service pressure.

Some pressure vessels are categorized by the International Standards Organization (ISO) 11439 Gas cylinders—High pressure cylinders for the on-board storage of natural gas as a fuel for automotive vehicles. ISO 11439 has four categories for Compressed Natural Gas (CNG) cylinders: Type I, Type II, Type III, and Type IV. These four categories are also seen in other standards including Federal Motor Vehicle Safety Standard (FMVSS) 304, and NGV2 (Natural Gas Vehicle). The CNG cylinders of all four categories are cylindrical with one or two domed ends.

The Type I cylinder 30, depicted in FIG. 1A, is an all-metal, (e.g. aluminum or steel) pressure vessel. Type I cylinders 30 are generally considered inexpensive, but relatively heavy compared to the other categories. The all-metal Type I pressure vessel does not require an over-wrap for strength enhancement.

Figure 1B:
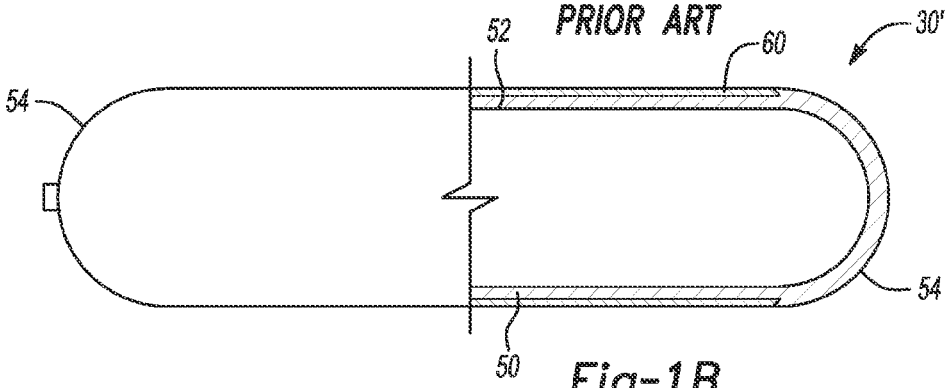
Fig-1B PRIOR ART
FIG. 1B is a cutaway, cross-sectional view of a Type II pressure vessel.

The Type II cylinders 30', depicted in FIG. 1B, are hoop-wrapped composite cylinders 30'. The steel or aluminum liner 50 has a thinner metal cylindrical center section 52 compared to the Type I cylinders 30. The metal end domes 54 are about the same thickness as the metal end domes 54 in the Type I cylinders 30. Therefore, only the cylindrical center section 52 may be reinforced with a composite over-wrap 60. Three types of fiber reinforcement are considered for the composite over-wrap 60 for Type II, III and IV cylinders in ISO 11439: glass; carbon; and aramid. The composite over-wrap 60 may be, "hoop wrapped" around the center section 52 of the Type II cylinders. The metal end domes 54 at one or both ends of the Type II cylinder 30' are of sufficient strength to withstand the pressures developed in the Type II cylinder 30' under normal use and are not over-wrapped. In type II cylinders 30', the metal liner 50 carries about 50% of the stress and the composite over-wrap 60 carries about 50% of the stress resulting from the internal pressure of the contained compressed fluid. The liner 50 of a Type II cylinder 30' is to contain a gas at the service pressure without leakage or rupture without the composite layer. Type II cylinders 30' may be lighter than type I cylinders 30 but may be more expensive.

Figure 1C:
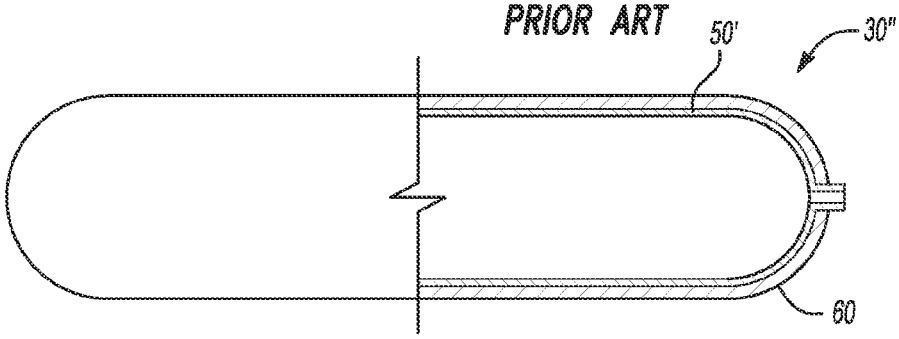
Fig-1C PRIOR ART
FIG. 1C is a cutaway, cross-sectional view of a Type III pressure vessel.

The Type III cylinders 30", depicted in FIG. 1C, have metal liners 50' that are fully wrapped with a composite over-wrap 60. The metal liners 50' are seamless and thin compared to the Type 1 liners 50. Between about 75% and about 95% of the strength of the Type III cylinders 30" comes from the composite over-wrap 60, and about 5% to about 25% of the strength comes from the metal liner 50'. Type III cylinders 30" may be substantially lighter in weight than the Type I and Type II cylinders 30, 30'. Type III cylinders 30" generally cost more than Type I and Type II cylinders 30, 30'.

Figure 1D:
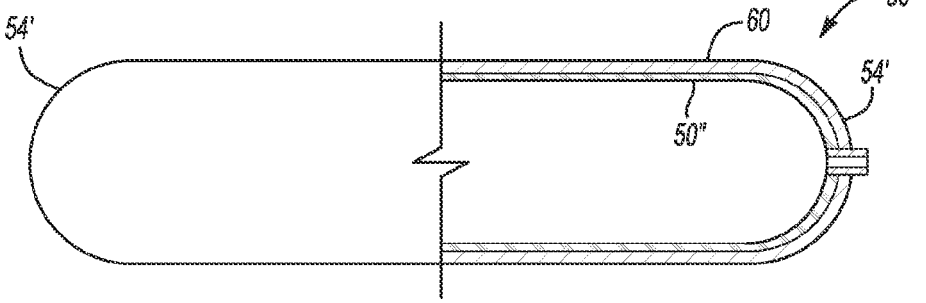
Fig-1D PRIOR ART
FIG. 1D is a cutaway, cross-sectional view of a Type IV pressure vessel.

The Type IV cylinders 30', depicted in FIG. 1D, have polymeric liners 50" that are fully wrapped with a composite over-wrap 60. The polymeric liners 50" provide substantially no structural strength to the Type IV composite cylinders 30'", and mainly serve as a permeation barrier to the contained gas. Type IV cylinders 30'" may include impact protection (not shown) over the domes 54' to compensate for a lack of rigidity in the polymeric liner 50".

Third Generation Advanced High Strength Steel (AHSS) means types of steel with strength-ductility combinations substantially better than exhibited by the first generation AHSS but at a cost substantially less than the cost corresponding to second generation AHSS. The strength-ductility combination of various types of steel are depicted on the Percent Elongation (δ) vs. Tensile Strength (TS) diagram in FIG. 2. The ranges of various types of steel depicted in FIG. 2 correspond to the reference numerals in Table 1, below:

TABLE 1

| Ref. # | Type | Definition of Acronym | Generation |
|---|---|---|---|
| 110 | IF | Interstitial Free | 0 |
| 111 | IF-HS | Interstitial Free High Strength | 0 |
| 112 | Mild | Mild | 0 |
| 113 | ISO | International Standards Organization | 0 |
| 114 | BH | Bake Hardenable | 0 |
| 115 | CMn | Carbon Manganese | 0 |
| 116 | HSLA | High Strength Low Alloy | 0 |
| 117 | DP, CP | Dual Phase, Complex Phase | 1 |
| 118 | TRIP | Transformation induced plasticity | 1 |
| 119 | MART | Martensitic | 1 |
| 120 | L-IP ® | Induced plasticity | 2 |
| 121 | TWIP | Twinning-induced plasticity | 2 |
| 122 | AUST. SS | Austenitic Stainless Steel | 2 |
| 123 | 3RDGEN | Third Generation | 3 |

In Table 1, steel types having a generation of 0 are not considered AHSS. Third Generation AHSS has Percent Elongation δ and Tensile Strength TS characteristics that generally fall between First Generation AHSS and Second Generation AHSS. Third Generation AHSS has Percent Elongation δ and Tensile Strength TS characteristics that are substantially bounded by the Third Generation Ellipse 123 in FIG. 2. The general equation for an ellipse centered at $(x_c, y_c)$ whose major axis (with radius of M) is on a line with a slope s, and whose minor axis has radius of m, is given by the solutions of:

$$\frac{((y-y_c)-(s)(x-x_c))^2}{m^2(1+s^2)}+\frac{(s(y-y_c)+(x-x_c))^2}{M^2(1+s^2)}=1 \quad \text{Eq. 1}$$

Figure 2:
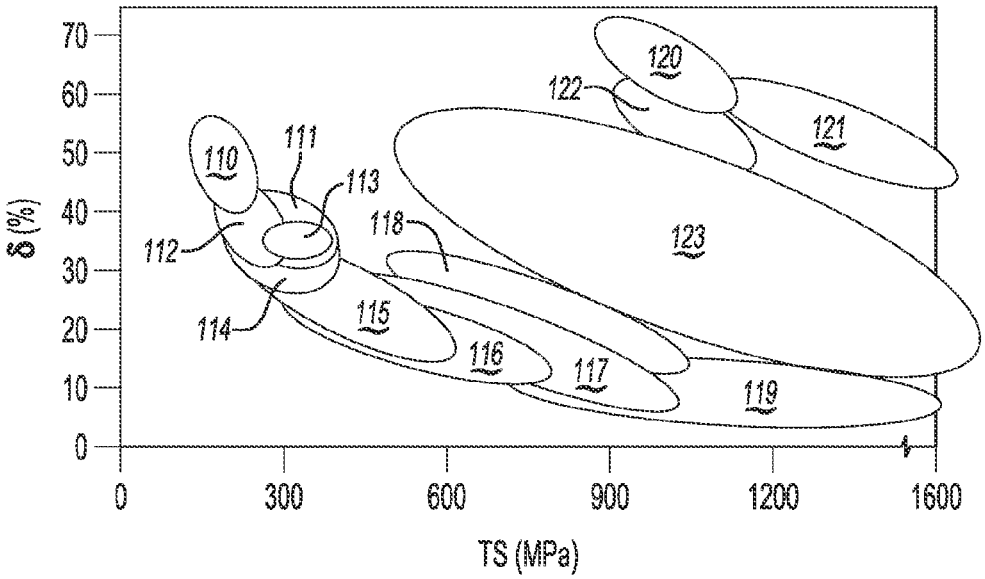
FIG. 2 is graph of Percent Elongation vs. Tensile Strength space depicting characteristics of various types of steel including third generation advanced high strength steel (AHSS) according to the present disclosure.

Applying the parameters of the Third Generation Ellipse 123 in FIG. 2, including compensation for the scale of the ordinate axis, yields the equation below:

$$\frac{(10(\delta-35)-(-.375)(TS-1050))^2}{150^2(1+(-.375)^2)}+\frac{(-.375(\delta-35)10+(TS-1050))^2}{550^2(1+(-.375)^2)}=1 \quad \text{Eq. 2}$$

Which simplifies to:

$$\frac{(10(\delta-35)-(-.375)(TS-1050))^2}{25664.0625}+\frac{(-.375(\delta-35)10+(TS-1050))^2}{345039.0625}=1 \quad \text{Eq. 3}$$

Therefore, the third generation AHSS has combinations of Percent Elongation δ and Tensile Strength TS bounded by the solutions of Eq. 3. Examples of the composite pressure vessel of the present disclosure may include a third generation AHSS filament with a Percent Elongation δ and a corresponding Tensile Strength TS bounded by solutions to Eq. 3. In Eq. 3, the Tensile Strength, TS is in units of MegaPascals (MPa).

Examples of the present disclosure may include a third generation AHSS filament having a tensile strength from about 800 MPa to about 1600 MPa and respective elongation δ from about 10 percent to about 60 percent.

An example of a third generation AHSS is Carbide-Free Bainitic (CFB) steel. Another example of a third generation AHSS is Quench and Partition (QP) Boron steel, also known as QP B-steel. Yet another example of a third generation AHSS is NanoSteel (NS), available from The NanoSteel Company, Inc., Providence, R.I. In examples of the composite pressure vessel of the present disclosure, the third generation AHSS filament may be, e.g. NanoSteel, Carbide-Free Bainitic (CFB) steel or Quench Partitioned Boron steel.

Figure 3:
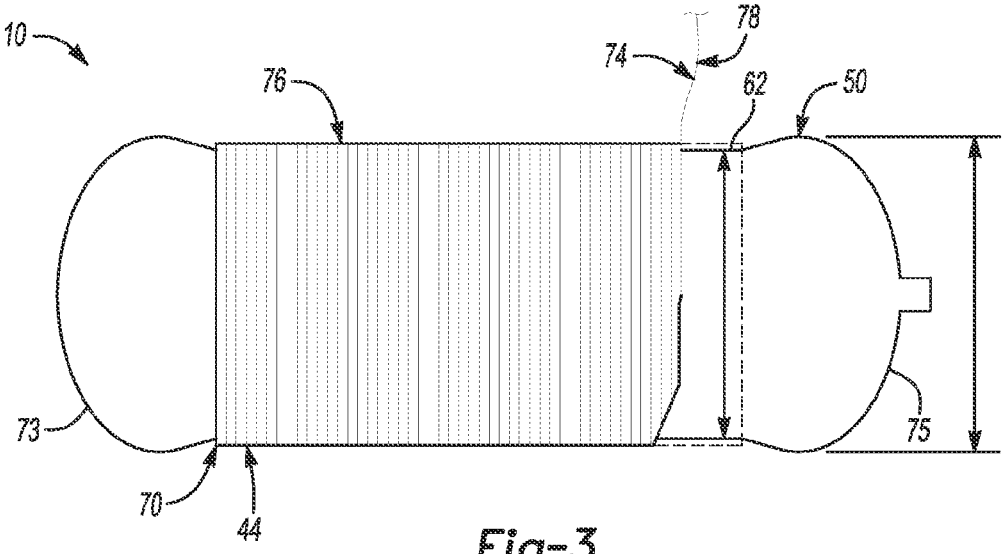
FIG. 3 is a top view of an example of a third generation AHSS filament being circumferentially wound upon a portion of an exterior surface of the liner of a composite pressure vessel according to the present disclosure.

Referring now to FIG. 3, an example of a composite pressure vessel 10 of the present disclosure is depicted. The example of the composite pressure vessel 10 depicted in FIG. 3 includes a liner 50 to contain a pressurized fluid, and a composite layer 70 formed on at least a portion of an exterior surface 62 of the liner 50. The composite layer 70 has a third generation AHSS filament reinforcement 74 embedded in a polymer matrix 76. The composite layer 70 includes a composite material 44. The composite material 44 may include a binding agent which acts as the matrix material. In an example, the matrix material may be a resin (some examples of which are provided above, e.g., polyesters, polypropylenes, etc.). It is to be understood that the third generation AHSS filament reinforcement 74 may be gathered into a strand or an end. Further, the third generation AHSS filament reinforcement 74 may be part of a roving or yarn.

Figure 4:
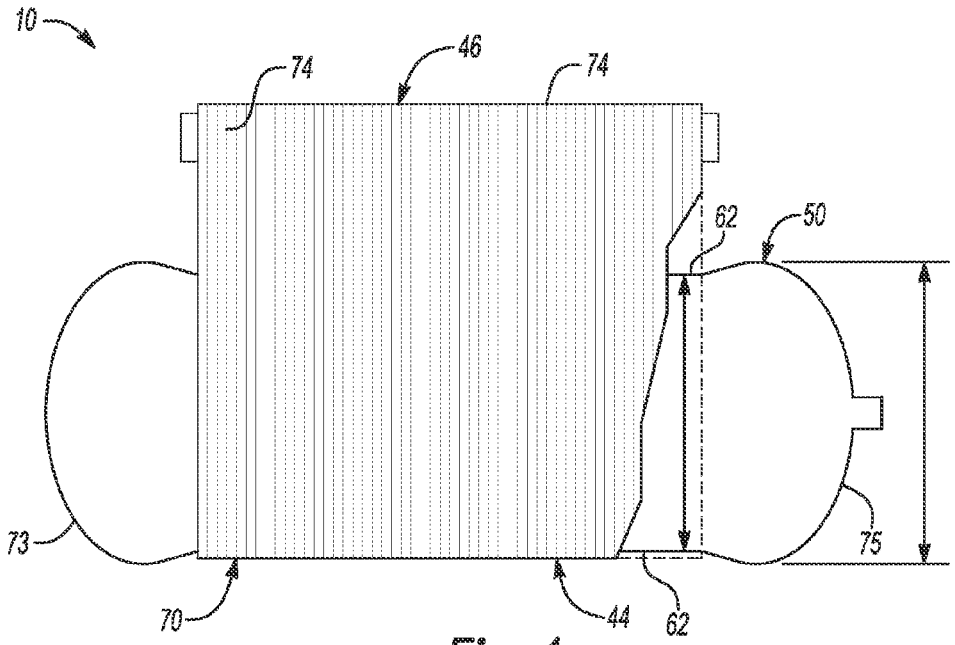
FIG. 4 is a top view of an example of a third generation AHSS filament woven into a fabric and the fabric being wrapped around a portion of an exterior surface of the liner of a composite pressure vessel according to the present disclosure.

FIG. 4 is a top view of an example of a third generation AHSS filament 74 woven into a fabric 46 and the fabric 46 being wrapped around a portion of an exterior surface 62 of the liner 50 of a composite pressure vessel 10 according to the present disclosure. The third generation AHSS filament 74 may be a monofilament 78 wound circumferentially around the tubular member 60 as depicted in FIG. 3. It is to be understood, however, that some third generation AHSS filaments 74 in the composite material 44 may be oriented in directions other than circumferential. For example, woven or nonwoven fabric or cloth that includes the third generation AHSS filament 74 may be wrapped around the substantially cylindrical portion 72 as depicted in FIG. 4. The substantially cylindrical portion 72 is the portion of the liner 50 that excludes the first and second domes 73, 75. Warp yarns in fabric may be oriented circumferentially, but fill yarns may be oriented crosswise to the warp yarns. As an example, a cloth having warp yarns that are circumferentially oriented may be used in the present disclosure. In another example, felt having some pieces of the third generation AHSS filament 74 oriented in the circumferential direction may be used. In woven and non-woven fabric, a percentage of circumferential third generation AHSS filaments 74 that contribute to an ultimate pressure carrying capability of the cylindrical pressure containment vessel 10 may be from about 90 percent to about 100 percent of the reinforcements in the fabric 46.

By including the third generation AHSS filaments 74 in the composite layer 70, examples of the composite pressure vessel 10 of the present disclosure may have better thermal management characteristics when compared to the carbon, glass, and aramid fiber reinforced composites of conventional Type II, III and IV tanks. When gas cylinders are filled to pressures in the range of 20 MPa to 25 MPa, the gas tends to heat up, temporarily lowering the mass of the gas that can be added at a particular pressure. The third generation AHSS filaments 74 conduct heat better than carbon, glass, and aramid fiber. The better heat conduction allows the mass of fuel in the composite pressure vessel 10 of the present disclosure to cool more quickly, thereby increasing the mass of fuel that can be added at a particular pressure when compared to a conventional Type II, III, or IV tank.

Figure 5:
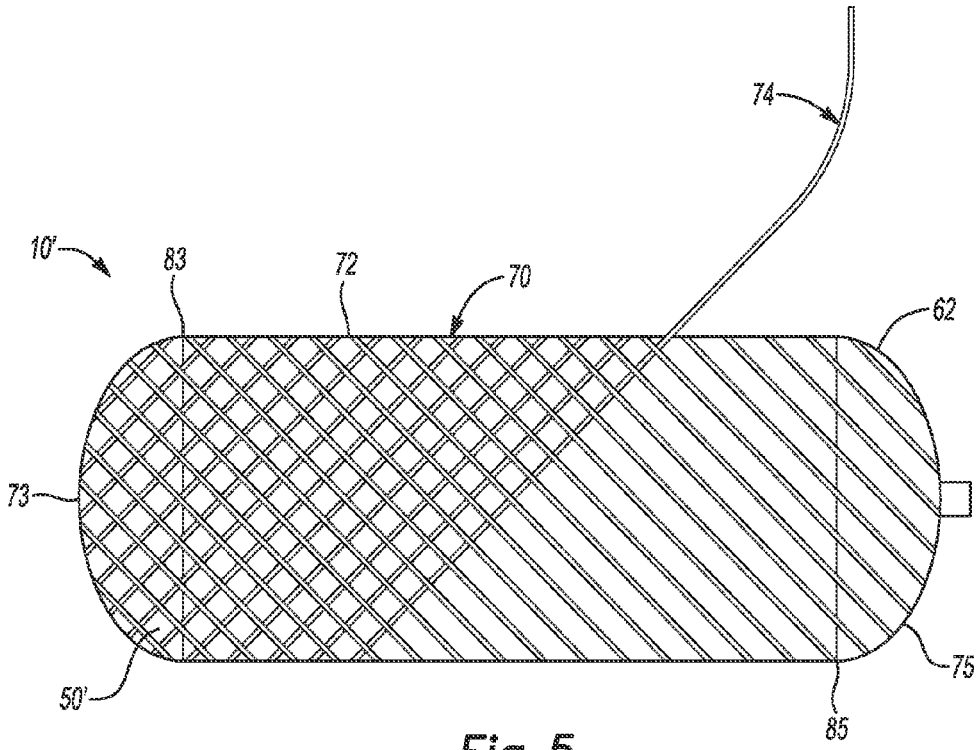
FIG. 5 is a top view of an example of a third generation AHSS filament being helically wound over an exterior surface of the cylindrical portion, the first dome, and the second dome of a composite pressure vessel according to the present disclosure.

FIG. 5 is a top view of an example of a third generation AHSS filament 74 being helically wound over an exterior surface 62 of the substantially cylindrical portion 72, the first dome 73, and the second dome 75 of a composite pressure vessel 10' according to the present disclosure.

Figure 6:
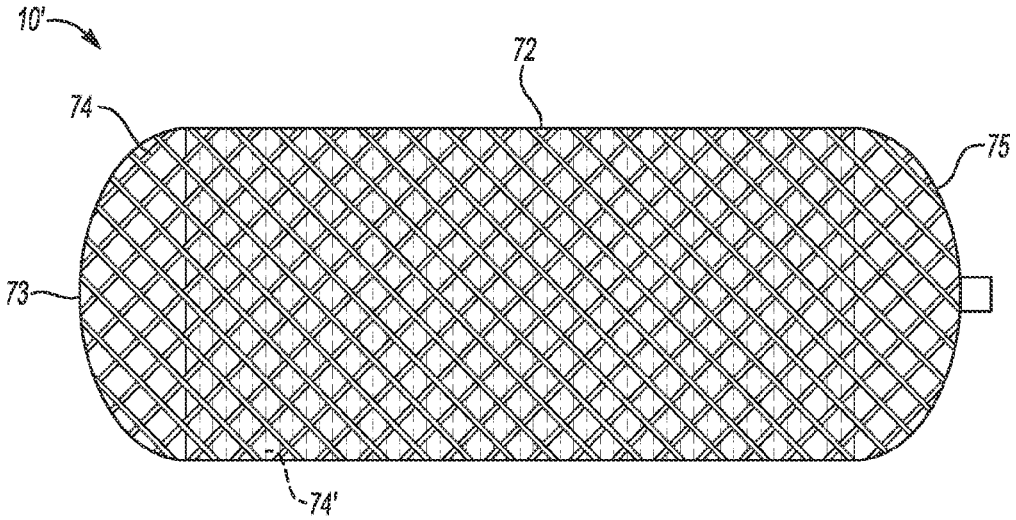
FIG. 6 is a top view of an example of a third generation AHSS filament helically wound over a circumferentially wound third generation AHSS filament upon an exterior surface of the cylindrical portion, the first dome, and the second dome of a composite pressure vessel according to the present disclosure.

FIG. 6 is a top view of an example of a third generation AHSS filament 74 helically wound over a circumferentially wound filament 74' upon an exterior surface 62 of the substantially cylindrical portion 72, the first dome 73, and the second dome 75 of a composite pressure vessel 10' according to the present disclosure.

Figure 7:
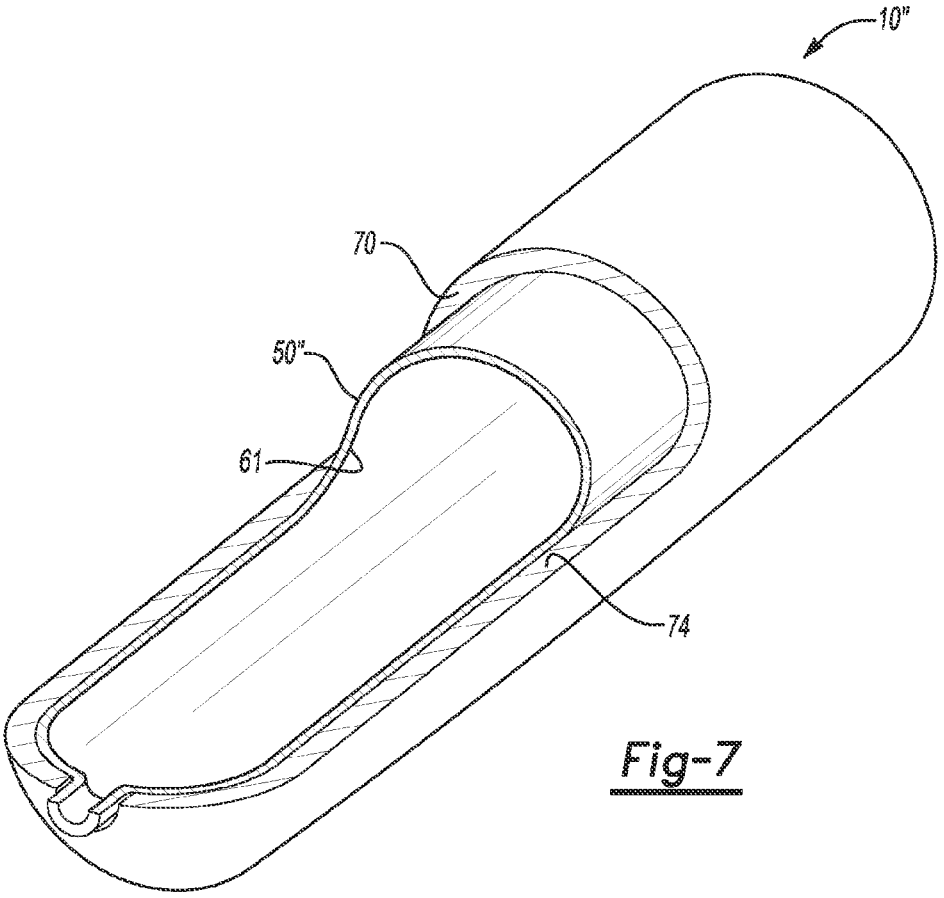
FIG. 7 is a cutaway, perspective view of an example of a third generation AHSS filament wound over a polymeric liner according to the present disclosure.

FIG. 7 is a cutaway, perspective view of an example of a composite pressure vessel 10" having a third generation AHSS filament reinforcement 74 wound in a composite layer 70 over a polymeric liner 50" according to the present disclosure.

In examples of the present disclosure, the third generation AHSS filament 74 may be helically wound upon at least a portion of the exterior surface 62 as depicted in FIGS. 5 and 6. In other examples, the third generation AHSS filament 74 may be circumferentially wound upon at least a portion of the exterior surface 62 as depicted in FIG. 3. In still further examples, the third generation AHSS filament may be woven into a fabric 46 and the fabric 46 may be wrapped around the at least portion of the exterior surface 62 as depicted in FIG. 4.

Examples of the composite pressure vessel 10, 10' of the present disclosure may include a liner 50, 50' formed from a metal. For example, the metal may be a steel alloy or an aluminum alloy. A thin (less than 0.002 inch) layer of another metal or plastic may be plated or deposited onto the interior surface 61 of the metal liner to improve chemical compatibility with the fluid contained by the composite pressure vessel 10, 10'. In other examples, the liner 50" may be formed from a polymer. In some examples, the polymeric liner may have a thin layer of a metal deposited on an interior surface 61 to reduce permeation of the fluid through the polymeric liner 50". In other examples, the polymeric liner 50" does not have a thin layer of metal deposited on the interior surface 61.

The liner 50, 50', 50" may be seamless or may be made by attaching or welding sections together, or by using rolled and welded tubing. In an example, the liner 50" (see FIG. 8) may include an array 40 of several tank sub-units 20 that communicate through apertures 34 made through the different faces of the tank sub-units 20. These tank sub-units 20 may be attached together using an adhesive. The array 40 may be wrapped with the third generation steel filament 74 to form a composite layer 70 and to mechanically support the structure against internal fluid pressure without welding the tank sub-units 20 together.

Figure 8:
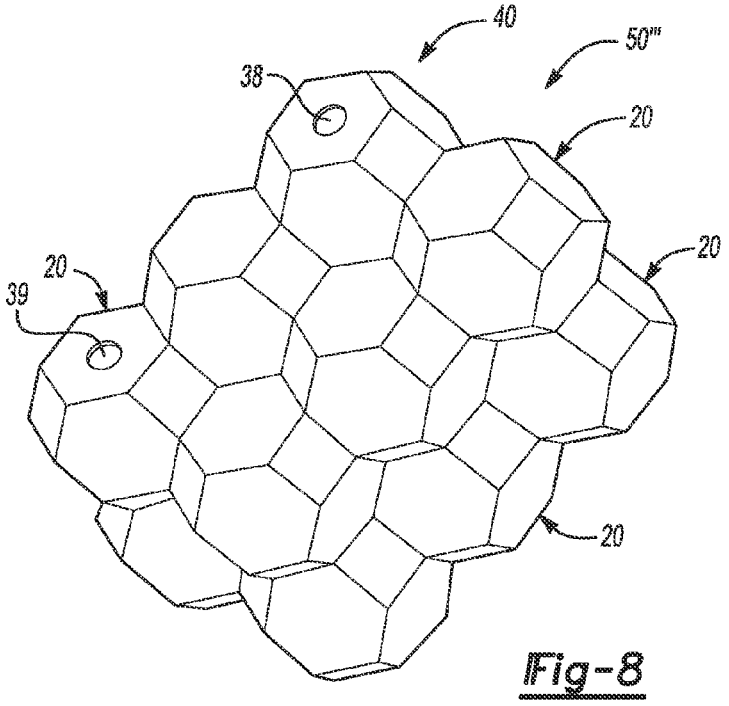
FIG. 8 is a perspective view of an array of truncated octahedron tank sub-units according to another example of the present disclosure.

Referring to FIG. 8, a liner 50' of an example of the present disclosure may include a plurality of tank sub-units 20 arranged to efficiently use the space available. In an example, a plurality of the tank sub-units 20 may be disposed in an array 40. Each tank sub-unit 20 is in fluid communication (directly, or indirectly through one or more adjacent tank sub-units 20) with a single outlet port 38. Each tank sub-unit 20 is also in fluid communication (directly, or indirectly through one or more adjacent tank sub-units 20) with a single fluid fill port 39. In an example, the single outlet port 38 is the single fluid inlet port 39. In other words, the functions of the single outlet port 38 and the single fluid inlet port 39 may be combined in a single inlet/outlet port.

In an example, each tank sub-unit 20 may be a primary parallelohedron. As such, the tank sub-units 20 may tessellate a 3-dimensional space. A uniform tessellation which fills three-dimensional Euclidean space with non-overlapping convex uniform polyhedral tank sub-units is also known as a convex uniform honeycomb. A honeycomb having all sub-units identical within its symmetries is isochoric. A sub-unit of an isochoric honeycomb is a space-filling polyhedron. Examples of space-filling polyhedra include: regular packings of cubes, hexagonal prisms, and triangular prisms; a uniform gyrated triangular prismatic honeycomb; a uniform packing of truncated octahedra; a rhombic dodecahedral honeycomb; a triakis truncated tetrahedral honeycomb; a trapezo-rhombic dodecahedral honeycomb; an elongated dodecahedron honeycomb; and a packing of any cuboid, rhombic hexahedron or parallelepiped.

As shown in FIG. 8, there is no unused space between adjacent tank sub-units 20 that are primary parallelohedra. The level of granularity, and thus, the efficiency of usage of space at the outside edges of the composite pressure vessel 10''' may depend on the size of the individual tank sub-units 20. However, it is to be understood that partial tank sub-units may be used to fill in the edges of the composite pressure vessel 10" according to an example of the present disclosure. In the example depicted in FIG. 8, each primary parallelohedron shaped tank sub-unit 20 is a truncated octahedron. Each of the tank sub-units 20 may be in fluid communication with adjacent tank sub-units 20 through aligned orifices/apertures 34 (shown in FIG. 9) in adjacent walls of the tank sub-units 20. In examples wherein the fluid is a liquid, the aligned orifices may be arranged to allow complete drainage of every tank sub-unit under the influence of gravity. It is to be understood that orifices may be in any side of a tank sub-unit with an adjacent tank sub-unit.

Figure 9:
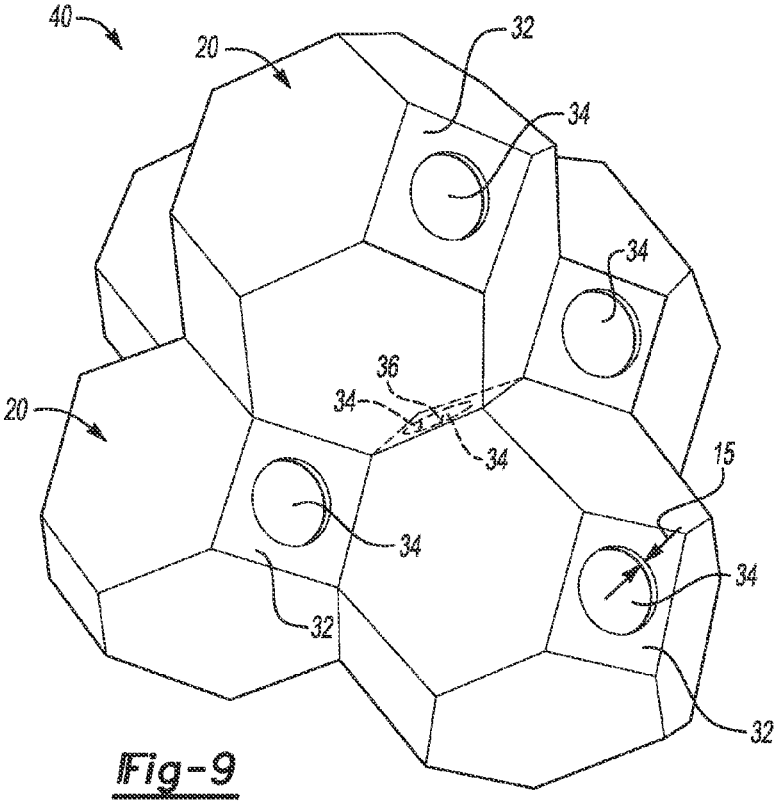
FIG. 9 is a perspective view of an array of truncated octahedron tank sub-units with apertures in square faces according to an example of the present disclosure.

FIG. 9 depicts an array 40 of truncated octahedron tank sub-units 20 with apertures 34 in some of the square faces 32. A wall thickness 15 of a face is depicted in FIG. 9. At reference numeral 36, an aperture 34 is defined in a wall overlapping with another aperture 34 in an adjacent tank sub-unit of the plurality of tank sub-units. Each tank sub-unit 20 has at least one such aperture 34 to provide fluid communication with an adjacent tank sub-unit 20. Some tank sub-units 20 of the present disclosure may have apertures 34 for direct fluid communication with more than one adjacent tank sub-unit 20. All of the tank sub-units 20 in the array 40 are ultimately in fluid communication with all of the other tank sub-units 20 in the array 40. It is to be understood that the fluid to be contained by the array 40 is completely contained within the array 40. In other words, no additional shell is required outside of the array to create a sealed vessel. It is to be understood that although no additional shell is required to seal the vessel, a shell may be used for other reasons including mechanical support, corrosion protection, or visual aesthetic appeal. The shell may be a composite layer 70 according to the present disclosure.

Figure 10:
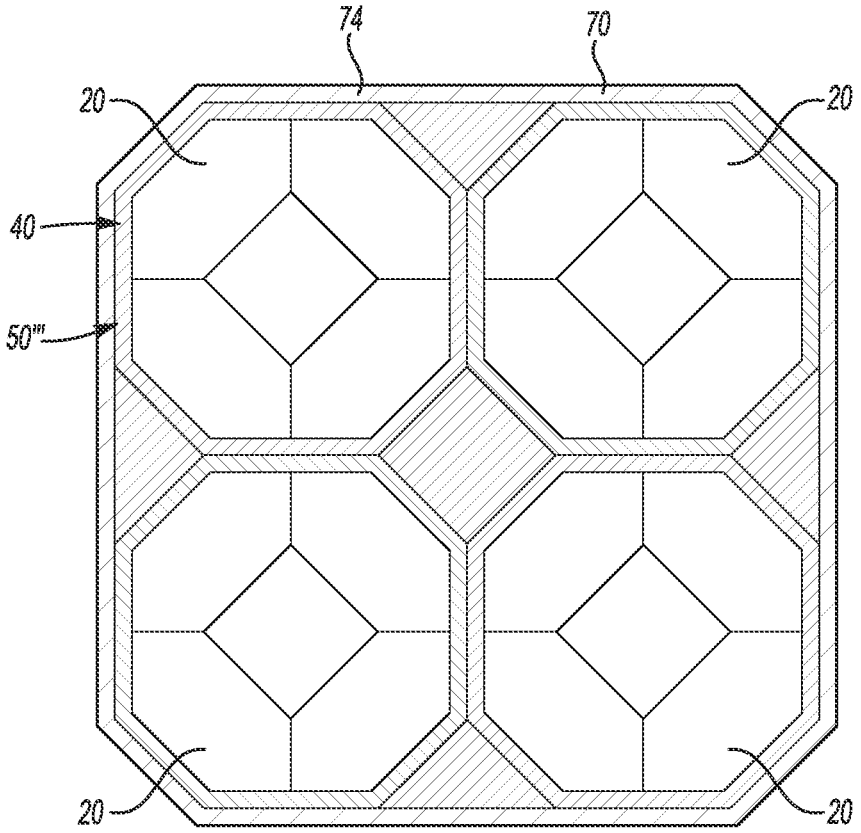
FIG. 10 is a cross-sectional view of an example of a third generation AHSS filament wound upon an array of truncated octahedron tank sub-units.

FIG. 10 is a cross-sectional view of an example of a third generation AHSS filament 74 wound upon an array 40 of truncated octahedron tank sub-units 20 in a composite pressure vessel 10''' of the present disclosure. The array 40 may be wrapped with the third generation steel filament 74 to form a composite layer 70 and to mechanically support the structure against internal fluid pressure without welding the tank sub-units 20 together. In an example, the tank sub-units 20 may be tack-welded together.

The liner 50 may have a cylindrical portion 72 and a dome 73 sealingly engaged with a first end 83 of the cylindrical portion 72 (see FIG. 5). The liner 50 may have a first dome 73 seamlessly disposed at a first end 83 of the cylindrical portion 72 and a second dome 75 seamlessly disposed at a second end 85 of the cylindrical portion 72. The liner 50 may be to contain a gas at a service pressure without leakage or rupture without the composite layer 70. In other examples, the liner 50', 50", 50''' may be made from relatively thin-walled metal or plastic. Such a liner 50', 50", 50''' may contain the gas at a pressure below the service pressure, but without the composite layer 70, such a liner may rupture or leak at the service pressure.

The third generation AHSS filament 74 may be circumferentially or helically wound upon the cylindrical portion 72. The third generation AHSS filament 74 may be circumferentially or helically wound over the cylindrical portion 72, the first dome 73, and the second dome 75. The composite pressure vessel 10, 10', 10", 10''' may be to have a burst ratio of a burst pressure to the service pressure ranging from about 2.25 to about 3.50. For example, if the service pressure is about 20 MPa, the burst pressure would range from about 45 MPa to about 70 MPa. In examples, the service pressure may range from about 20 MPa to about 25 MPa.

The composite pressure vessel 10, 10', 10", 10''' may be used to contain pressurized fluid (not shown). It is to be understood that fluids contained by the composite pressure vessel assembly 10, 10', 10", 10''' may be liquids, gases, mixtures, solutions, and combinations thereof. Materials contacted by the fluids contained by the composite pressure vessel assembly 10, 10', 10", 10'" may be selected to be chemically compatible with the fluid. In an example, the composite pressure vessel 10, 10', 10", 10'" may be a fuel tank.

It is to be understood that the ranges provided herein include the stated range and any value or sub-range within the stated range. For example, a range of from about 10 percent to about 60 percent should be interpreted to include not only the explicitly recited limits of about 10 percent to about 60 percent, but also to include individual values, such as 20 percent, 31.3 percent, etc., and sub-ranges, such as from about 15 percent to 48 percent, etc. Furthermore, when "about" is utilized to describe a value, this is meant to encompass minor variations (up to +/−10%) from the stated value.

Reference throughout the specification to "one example", "another example", "an example", and so forth, means that a particular element (e.g., feature, structure, and/or characteristic) described in connection with the example is included in at least one example described herein, and may or may not be present in other examples. In addition, it is to be understood that the described elements for any example may be combined in any suitable manner in the various examples unless the context clearly dictates otherwise.

In describing and claiming the examples disclosed herein, the singular forms "a", "an", and "the" include plural referents unless the context clearly dictates otherwise.

While several examples have been described in detail, it will be apparent to those skilled in the art that the disclosed examples may be modified. Therefore, the foregoing description is to be considered non-limiting.

The invention claimed is:

1. A composite pressure vessel, comprising:

a liner to contain a pressurized fluid; and a composite layer formed on at least a portion of an exterior surface of the liner, the composite layer including a third generation advanced high strength steel (AHSS) filament reinforcement having a tensile strength from about 800 MPa to about 1600 MPa and respective elongation from about 60 percent to about 10 percent embedded in a polymer matrix.

2. The composite pressure vessel as defined in claim 1 wherein the third generation AHSS filament is helically wound upon the at least portion of the exterior surface.

3. The composite pressure vessel as defined in claim 1 wherein the third generation AHSS filament is circumferentially wound upon the at least portion of the exterior surface.

4. The composite pressure vessel as defined in claim 1 wherein the third generation AHSS filament is woven into a fabric and the fabric is wrapped around the at least portion of the exterior surface.

5. The composite pressure vessel as defined in claim 1 wherein a Percent Elongation δ and a corresponding Tensile Strength TS of the third generation AHSS filament is bounded by solutions to $$\frac{(10(\delta-35)-(-.375)(TS-1050))^2}{25664.0625}+\frac{(-.375(\delta-35)10+(TS-1050))^2}{345039.0625}=1,$$

wherein TS is in units of MegaPascals (MPa).

6. The composite pressure vessel as defined in claim 5 wherein the third generation AHSS filament is NanoSteel, Carbide-Free Bainitic (CFB) steel or Quench Partitioned Boron steel.

7. The composite pressure vessel as defined in claim 1 wherein:

the liner is formed from a metal;

the liner has a cylindrical portion;

the liner has a dome sealingly engaged with a first end of the cylindrical portion;

the liner is to contain a gas at a service pressure without leakage or rupture without the composite layer;

the third generation AHSS filament is circumferentially or helically wound upon the cylindrical portion; and the composite pressure vessel is to have a burst ratio of a burst pressure to the service pressure of at least 2.25.

8. The composite pressure vessel as defined in claim 7 wherein the service pressure is from about 20 MPa to about 25 MPa.

9. The composite pressure vessel as defined in claim 7 wherein a Percent Elongation δ and a corresponding Tensile Strength TS of the third generation AHSS filament is bounded by solutions to $$\frac{(10(\delta-35)-(-.375)(TS-1050))^2}{25664.0625}+\frac{(-.375(\delta-35)10+(TS-1050))^2}{345039.0625}=1,$$

wherein TS is in units of MegaPascals (MPa).

10. The composite pressure vessel as defined in claim 9 wherein the third generation AHSS filament is NanoSteel, Carbide-Free Bainitic (CFB) steel or Quench Partitioned Boron steel.

11. The composite pressure vessel as defined in claim 1 wherein:

the liner is formed from a metal;

the liner is seamless;

the liner has a cylindrical portion;

the liner has a first dome seamlessly disposed at a first end of the cylindrical portion;

the liner has a second dome seamlessly disposed at a second end of the cylindrical portion;

the third generation AHSS filament is circumferentially or helically wound over the cylindrical portion, the first dome, and the second dome;

the composite pressure vessel is to contain a gas at a service pressure without leakage or rupture; and the composite pressure vessel is to have a burst ratio of a burst pressure to the service pressure of at least 2.25.

12. The composite pressure vessel as defined in claim 11 wherein the service pressure is from about 20 MPa to about 25 MPa.

13. The composite pressure vessel as defined in claim 11 wherein a Percent Elongation δ and a corresponding Tensile Strength TS of the third generation AHSS filament is bounded by solutions to $$\frac{(10(\delta-35)-(-.375)(TS-1050))^2}{25664.0625}+\frac{(-.375(\delta-35)10+(TS-1050))^2}{345039.0625}=1,$$

wherein TS is in units of MegaPascals (MPa).

14. The composite pressure vessel as defined in claim 13 wherein the third generation AHSS filament is NanoSteel, Carbide-Free Bainitic (CFB) steel or Quench Partitioned Boron steel.

15. The composite pressure vessel as defined in claim 1 wherein:

the liner is formed from a polymer;

the liner has a cylindrical portion;

the liner has a first dome sealingly disposed at a first end of the cylindrical portion;

the liner has a second dome sealingly disposed at a second end of the cylindrical portion;

the third generation AHSS filament is circumferentially or helically wound over the cylindrical portion, the first dome, and the second dome;

the composite pressure vessel is to contain a gas at a service pressure without leakage or rupture; and the composite pressure vessel is to have a burst ratio of a burst pressure to the service pressure of at least 2.25.

16. The composite pressure vessel as defined in claim 15 wherein the service pressure is from about 20 MPa to about 25 MPa.

17. The composite pressure vessel as defined in claim 15 wherein a Percent Elongation δ and a corresponding Tensile Strength TS of the third generation AHSS filament is bounded by solutions to $$\frac{(10(\delta-35)-(-.375)(TS-1050))^2}{25664.0625}+\frac{(-.375(\delta-35)10+(TS-1050))^2}{345039.0625}=1,$$

wherein TS is in units of MegaPascals (MPa).

18. The composite pressure vessel as defined in claim 17 wherein the third generation AHSS filament is NanoSteel, Carbide-Free Bainitic (CFB) steel or Quench Partitioned Boron steel.

19. The composite pressure vessel as defined in claim 1 wherein:

the liner is formed from a plurality of tank sub-units disposed in an array;

each tank sub-unit of the plurality of tank sub-units has an aperture defined in at least one wall overlapping with an other aperture defined in at least one adjacent tank sub-unit of the plurality of tank sub-units;

each tank sub-unit of the plurality of tank sub-units is in fluid communication with a single outlet port for selectively extracting the fluid from the tank;

each tank sub-unit of the plurality of tank sub-units is in fluid communication with a single fluid fill port;

the composite pressure vessel is to contain a gas at a service pressure without leakage or rupture;

the third generation AHSS filament is wound upon the array; and the composite pressure vessel is to have a burst ratio of a burst pressure to the service pressure of at least 2.25.

20. A composite pressure vessel, comprising:

a liner to contain a pressurized fluid, wherein the liner is formed from a metal, wherein the liner has a cylindrical portion and has a dome sealingly engaged with a first end of the cylindrical portion; and a composite layer formed on at least a portion of an exterior surface of the liner, the composite layer including a third generation advanced high strength steel filament (AHSS) reinforcement having a tensile strength from about 800 MPa to about 1600 MPa and respective elongation from about 60 percent to about 10 percent embedded in a polymer matrix, wherein the third generation AHSS filament is circumferentially or helically wound over the cylindrical portion and the composite pressure vessel has a burst ratio of a burst pressure to the service pressure of at least 2.25.

21. A composite pressure vessel, comprising:

a liner to contain a pressurized fluid, wherein the liner is formed from a metal and is seamless, wherein the liner has a cylindrical portion, a first dome seamlessly disposed at a first end of the cylindrical portion, and a second dome seamlessly disposed at a second end of the cylindrical portion; and a composite layer formed on at least a portion of an exterior surface of the liner, the composite layer including a third generation advanced high strength steel filament (AHSS) reinforcement having a tensile strength from about 800 MPa to about 1600 MPa and respective elongation from about 60 percent to about 10 percent embedded in a polymer matrix, wherein the third generation AHSS filament is circumferentially or helically wound over the cylindrical portion, the first dome, and the second dome, and the composite pressure vessel has a burst ratio of a burst pressure to the service pressure of at least 2.25.

* * * * *